US007258567B2

(12) United States Patent
Tanaka et al.

(10) Patent No.: US 7,258,567 B2
(45) Date of Patent: Aug. 21, 2007

(54) BOARD MOUNTING TYPE CONNECTOR WITH METAL FASTENING MEMBER

(75) Inventors: Tetsuji Tanaka, Mie (JP); Hiroki Hirai, Mie (JP); Tatsuo Tamagawa, Mie (JP); Hiroomi Hiramitsu, Mie (JP); Yoshito Sakai, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/185,869

(22) Filed: Jul. 21, 2005

(65) Prior Publication Data

US 2006/0019511 A1 Jan. 26, 2006

(30) Foreign Application Priority Data

Jul. 21, 2004 (JP) ..... P2004-212627

(51) Int. Cl.
*H01R 13/627* (2006.01)

(52) U.S. Cl. ..... 439/355

(58) Field of Classification Search ..... 439/567, 439/541.5, 607, 571, 572, 346, 351, 355, 439/352, 377, 368

See application file for complete search history.

(56) References Cited

U.S. PATENT DOCUMENTS

| | | | | |
|---|---|---|---|---|
| 5,478,253 | A * | 12/1995 | Biechler et al. | 439/181 |
| 5,759,057 | A * | 6/1998 | Cheng et al. | 439/328 |
| 6,692,273 | B1 * | 2/2004 | Korsunsky et al. | 439/108 |
| 6,869,301 | B2 * | 3/2005 | Shimizu et al. | 439/324 |
| 2003/0104726 | A1 * | 6/2003 | Masumoto | 439/607 |

FOREIGN PATENT DOCUMENTS

| | | |
|---|---|---|
| JP | A 5-326049 | 12/1993 |

* cited by examiner

*Primary Examiner*—Chandrika Prasad
(74) *Attorney, Agent, or Firm*—Oliff & Berridge PLC

(57) ABSTRACT

A board mounting type connector includes: a housing being made of a resin, the housing holding a plurality of terminals, each terminal being arranged in parallel and connected to a circuit board; and a metal fastening member being fixed to both ends of the housing in a widthwise direction of the housing in which the terminals are arranged, the metal fastening member being mounted to the circuit board, and each metal fastening member having an engaging portion which engages with a housing of a counterpart connector fitted into the board mounting type connector so that the connectors are engageable to each other in a fitted state.

7 Claims, 17 Drawing Sheets

BOARD MOUNTING TYPE CONNECTOR WITH METAL FASTENING MEMBER

BACKGROUND OF THE INVENTION

1. Field of the Invention

The present invention relates to a board mounting type connector which is mounted to a circuit board.

2. Description of the Related Art

In a related art, a connector connection structure has been disclosed. In this structure, a female connector is configured such that each of male terminals is mounted to the distal end of each of discrete wires and is received in each of a plurality of terminal-receiving cavities which are formed in parallel in a housing of the female connector, and a male connector (a board mounting type connector) is configured such that a housing of the male connector which receives female terminals is mounted to a printed circuit board. The discrete wires can be electrically connected to a circuit on the printed circuit board through the male and female terminals by coupling the female and male connectors to each other.

SUMMARY OF THE INVENTION

In this type of connectors, for example, applied to various electric instruments provided on a motor vehicle, as miniaturization of the connectors is required to meet increasing demand toward improvement of efficiency of space utilization, the following problems have been caused.

Generally, this type connector is configured so that engaging portions are integrally provided with the housings of the connectors and the connectors are locked to each other by engaging the engaging portions with each other. However, as the housings of the connectors are miniaturized, the positions or sizes of the engaging portions cannot but be limited, whereby it is difficult to properly design and manufacture the housings of the connectors in consideration of a relationship with molds.

Therefore, it is necessary to appropriately and simply miniaturize connectors and form engaging portions on the housings of the connectors, which have sufficient locking strength.

When fitting the connectors with each other, a worker confirms the completely fitted state by sense or sound (lock feeling) which is transmitted or generated at the moment the engaging portion of one connector is engaged with the housing of the other connector. In this regard, since the size of the engaging portion decreases with the miniaturization of the connectors, the lock feeling when fitting the connectors with each other cannot but be deteriorated. Therefore, it is difficult to properly confirm the completely fitted state, whereby workability deteriorates.

It is an object of the invention to provide a board mounting type connector which can be reliably miniaturized and in which a engaging portion having sufficient locking strength can be properly and simply formed.

It is an another object of the invention to provide a board mounting type connector capable of securing improved lock feeling upon fitting connectors with each other.

According to one aspect of the invention, there is provided a board mounting type connector including: a housing being made of a resin, the housing holding a plurality of terminals, each terminal being arranged in parallel and connected to a circuit board; and a metal fastening member being fixed to both ends of the housing in a widthwise direction of the housing in which the terminals are arranged, the metal fastening member being mounted to the circuit board, and each metal fastening member having an engaging portion which engages with a housing of a counterpart connector fitted into the board mounting type connector so that the connectors are engageable to each other in a fitted state.

By thus configuration, in which the engaging portion for engaging the counterpart connector in the fitted state is formed on each of the metal fastening members, it is not necessary to form a engaging portion on the housing of the board mounting type connector and the housing can be easily designed and manufactured, whereby the engaging portion can be formed in a simply manner. In particular, since the engaging portion is made of metal to be advantageous in terms of strength, it is possible to prevent the engaging portion from being deformed, whereby locking strength of the connectors can be improved.

According to another aspect of the invention, the engaging portion has an elastic member. The elastic member is elastically displaced by a housing of the counterpart connector when the connectors are fitted with each other. When the connectors are completely fitted, the elastic member elastically returns to an original unbent state such that the engaging portion is engaged with the housing of the counterpart connector.

since a completely fitted state of the housings can be confirmed by sound or vibration (clash feeling) which is generated due to contact between the elastic member and the housing of the counterpart connector when the elastic member returns from the bent state to its original unbent state (that is, since lock feeling is improved), both of the connectors can be adequately and quickly fitted with each other.

According to another aspect of the invention, the housing of the board mounting type connector is provided with a fitting recess into which the housing of the counterpart connector is inserted to be fitted therein. The elastic member is disposed in the fitting recess. An inner surface of the fitting recess has a contact portion with which the elastic member comes into contact. As the housing of the counterpart connector is inserted into the fitting recess, the elastic member is elastically bent by the housing of the counterpart connector in a direction in which the elastic member goes away from the contact portion. When both of the connectors are completely fitted with each other, the elastic member elastically returns to an original unbent state and comes into contact with the contact portion.

Since the elastic member can come into contact with the outer housing (that is, the housing of the board mounting type connector) of the inner and outer housings which are fitted with each other, a worker can easily hear or feel sound or vibration (clash feeling). That is, the lock feeling is further improved.

According to another aspect of the invention, an engaged portion is formed on the housing of the counterpart connector to be engaged with the engaging portion of each metal fastening member. The engaged portion of the housing of the counterpart connector has a guide surface which comes into contact with the engaging portion such that the elastic member is elastically bent in the direction in which the elastic member goes away from the contact portion. As the housing of the counterpart connector is inserted into the fitting recess, the engaging portion is guided on the guide surface whereby the elastic member is elastically displaced. When the connectors are completely fitted, the engaging portion is released from the guide surface, the elastic member elastically returns to the original unbent state, and the engaging portion is engaged with the engaged portion of the housing of the counterpart connector.

By thus configuration, when the connectors are fitted with each other, sound or vibration (clash feeling) can be generated, with simple construction.

According to another aspect of the invention, each metal fastening member has a contact portion which faces the elastic member. The contact portion comes into contact with the elastic member when the elastic member returns to the original unbent state from a bent state.

By thus configuration, when the connectors are fitted with each other, since big metallic sound is generated due to clash between metallic materials, the lock feeling can be effectively improved.

According to another aspect of the invention, at least one side of the contact plate part and the elastic member contacted to the contact plate part is formed with a protrusion. The protrusion protrudes toward the other side of the contact plate part and the elastic member. It is possible to effectively generate more clear clash sound when compared to the case in which flat surfaces are brought into contact with each other.

According to another aspect of the invention, a plurality of terminal arrays having the plurality of terminals arranged in parallel are formed in a direction perpendicular to the widthwise direction. The terminal arrays have a first terminal array and a second terminal array. All terminals of the first terminal array are staggered by one half pitch from all terminals of the second terminal array in the widthwise direction. Each metal fastening member has the elastic member which can be elastically bent in the widthwise direction. The elastic member is located at a side of an endmost terminal among terminals of the first and second terminal arrays which is close to a widthwise center of the housing of the board mounting type connector.

By thus configuration, the terminal arrays are staggered from each other in the widthwise direction, it is possible to allow the elastic members of the metal fastening members to be bent into the extra spaces defined at both widthwise ends of the housing. That is, the metal fastening members can be compactly inserted into the housing while securing sufficient flexure margin of the elastic members.

According to the above-aspects of the invention, since the engaging portion to be engaged with the housing of the counterpart connector is formed on each metal fastening member, when compared to the related art in which a engaging portion is formed on the housing of a board mounting type connector, it is possible to adequately and simply form the engaging portion having sufficient locking strength.

According to the above-aspects of the invention, since the completely fitted state of the housings can be confirmed through sound or vibration (clash feeling) which is generated when the elastic member returns to its original unbent state, the lock feeling can be improved. Therefore, it is possible to effectively miniaturize the connectors and improve workability when fitting the connectors with each other.

BRIEF DESCRIPTION OF THE DRAWINGS

FIG. 3 is cross-sectional views illustrating the board mounting type connector wherein

FIG. 5 is views illustrating a wiring material-side connector wherein

FIG. 6A, 6B are views illustrating the housing of the wiring material-side connector and a terminal (mounted to a discrete wire) which is inserted into the housing wherein FIG. 6A represents a state before the terminal is inserted into the housing and FIG. 6B represents a state after the terminal is inserted into the housing.

FIG. 7A, 7B are perspective views illustrating the discrete wire and the terminal which is mounted to the distal end of the discrete wire wherein FIG. 7A represents a state before the terminal is mounted to the discrete wire and FIG. 7B represents a state after the terminal is mounted to the discrete wire.

FIG. 11A, 11B are longitudinal cross-sectional views explaining a procedure for connecting the board mounting type connector and the wiring material-side connector wherein FIG. 11A represents a state before connection and FIG. 11B represents a state after connection.

FIG. 12A, 12B are transverse cross-sectional views explaining the procedure for connecting the board mounting type connector and the wiring material-side connector wherein FIG. 12A represents the state before connection and FIG. 12B represents the state after connection.

FIG. 15 is cross-sectional views illustrating main parts of the board mounting type connector and the wiring material-side connector wherein

DESCRIPTION OF THE PREFERRED EMBODIMENTS

Hereinafter, a board mounting type connector according to a preferred embodiment of the invention will be described with reference to accompanying drawings.

Figure 1:
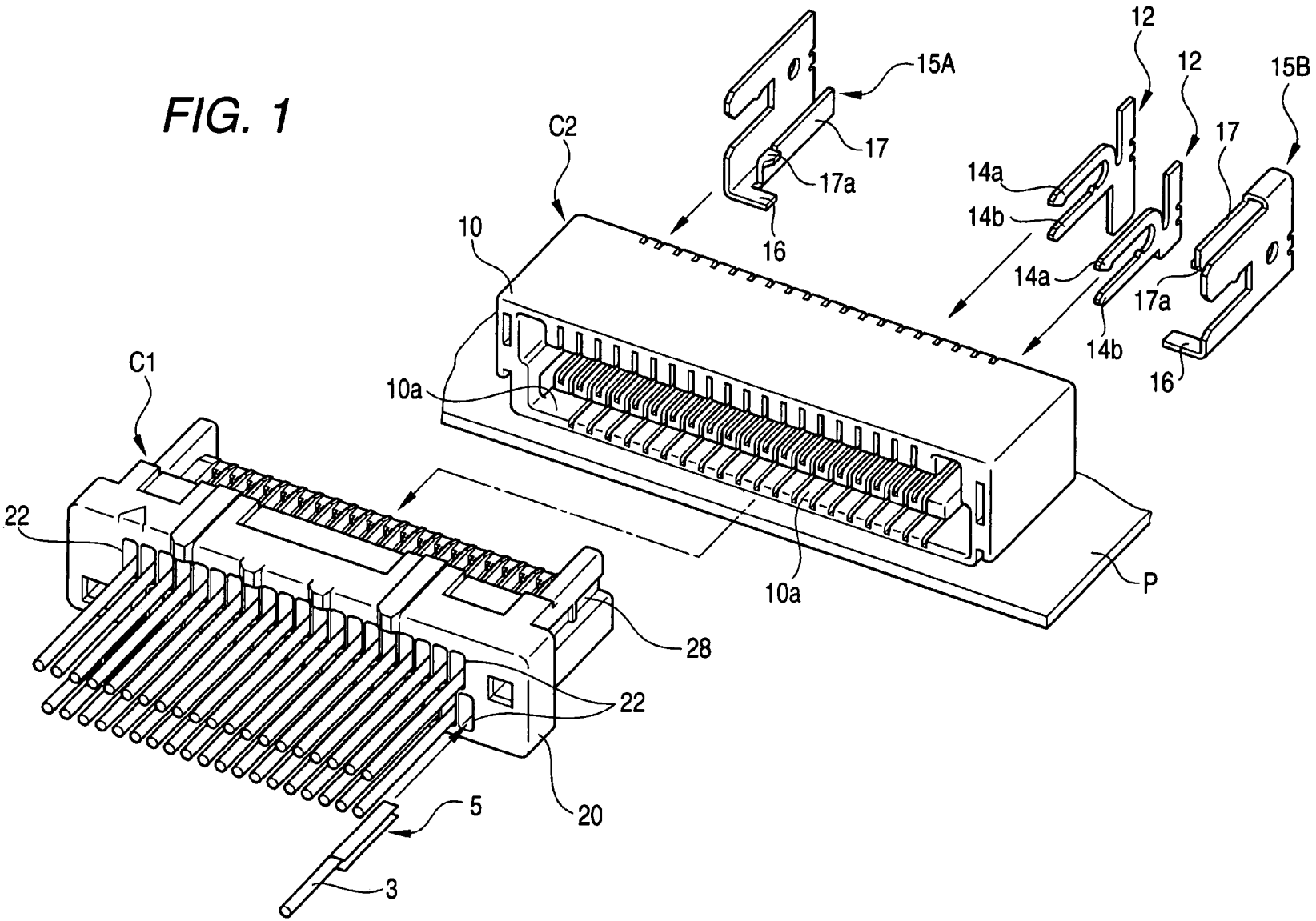
FIG. 1 is a partially exploded perspective view of connector according one embodiment.

FIG. 1 is a perspective view schematically illustrating the construction of a connector for electrically connecting discrete wires to a circuit board. In FIG. 1, a terminal and some components are illustrated in a disassembled state.

In FIG. 1, the reference numeral C2 indicates a board-side connector that corresponds to a board mounting type connector according one embodiment. The board-side connector C2 is fixedly maintained in a state in which it is mounted on the surface of a circuit board P. Also, the reference numeral C1 indicates a wiring material-side connector. The wiring material-side connector C1 is structured to connect discrete wires 3 to the circuit board P by being coupled to the board-side connector C2.

The board-side connector C2 includes a connector housing 10 (hereinafter, referred to as a housing 10). The housing 10 has a fitting recess 10*a* into which the wiring material-side connector C1 is fitted, and has a configuration which is slim and long in the widthwise direction of the housing 10.

Figure 2:
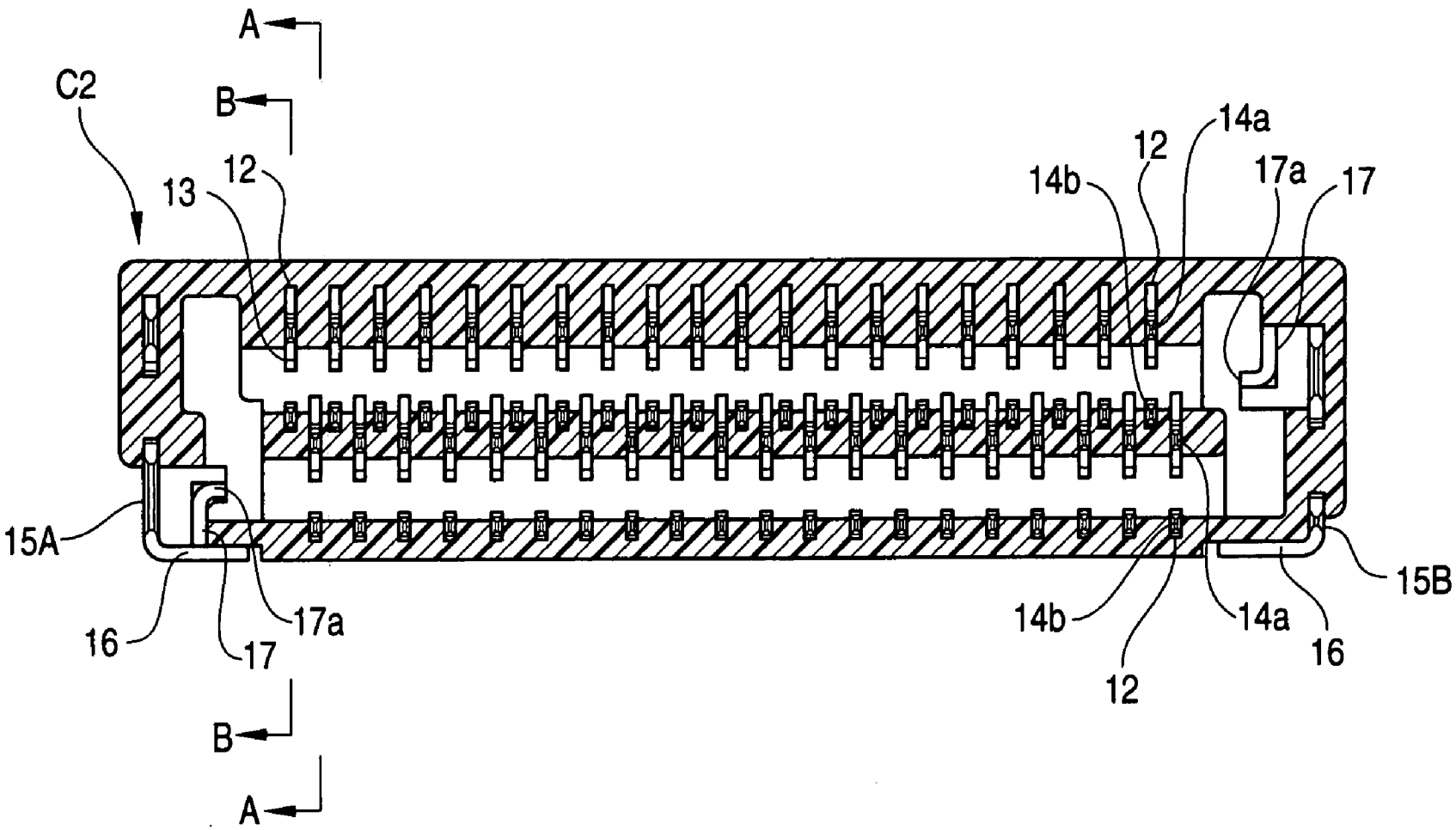
FIG. 2 is a cross-sectional view of a board mounting type connector.
Figure 3B:
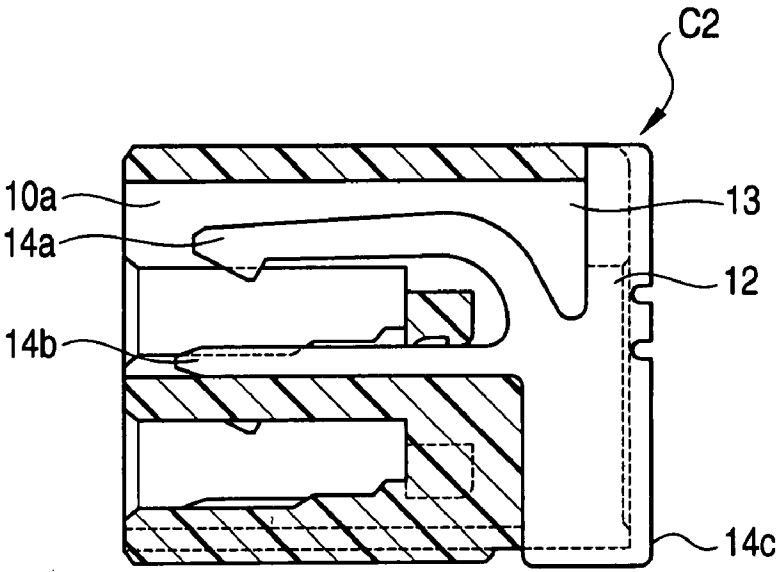
FIG. 3B is a cross-sectional view taken along the line B-B of FIG. 2.
Figure 3A:
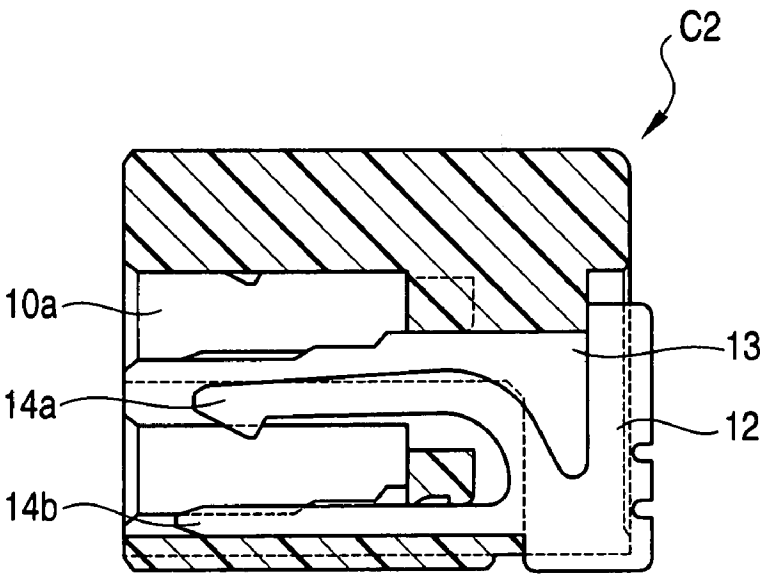
FIG. 3A is a cross-sectional view taken along the line A-A of FIG. 2

In the housing 10, as shown in FIGS. 2 and 3, a plurality of terminal-receiving cavities 13 are provided in parallel in the widthwise direction (the leftward and rightward direction in FIG. 2) so as to create a two-tier array including upper and lower terminal-receiving cavities 13. As shown in FIGS. 2 and 3, the upper and lower terminal-receiving cavities 13 are staggered from each other by one half pitch to allow the upper and lower terminal-receiving cavities 13 to be arranged alternately with each other, whereby the terminal-receiving cavities 13 are arrayed in a zigzag over the entire housing 10.

A plurality of terminals 12 is received in the plurality of terminal-receiving cavities 13, respectively. Each of the terminals 12 is a female terminal, which includes a contact portion at the front (the left end in FIG. 3) thereof and a leg part 14*c* at the rear thereof. The contact portion is formed in a fork-shape (U-shape). The contact portion has a flexible piece 14*a*, which can be bent upward and downward, and a support portion 14*b*, which is connected to and positioned below the flexible piece 14*a* (elastic member). Each of the terminals 12 is received in the terminal-receiving cavity 13 by being inserted from the rear of the housing 10. Since the leg part 14*c* is soldered to the fixing land of the circuit board P, each of the terminals 12 is electrically connected to a circuit (pattern) formed on the circuit board P. Further, since each of the terminals 12 received in the upper terminal-receiving cavities 13 has the leg part 14*c* which is longer than that of each of the terminals 12 received in the lower terminal-receiving cavities 13, each of the terminals 12 can be properly soldered to the circuit board P.

A pair of metal fastening members 15A and 15B for fastening the board-side connector C2 (the housing 10) to the circuit board P are respectively inserted into both widthwise ends of the housing 10.

Figure 4:
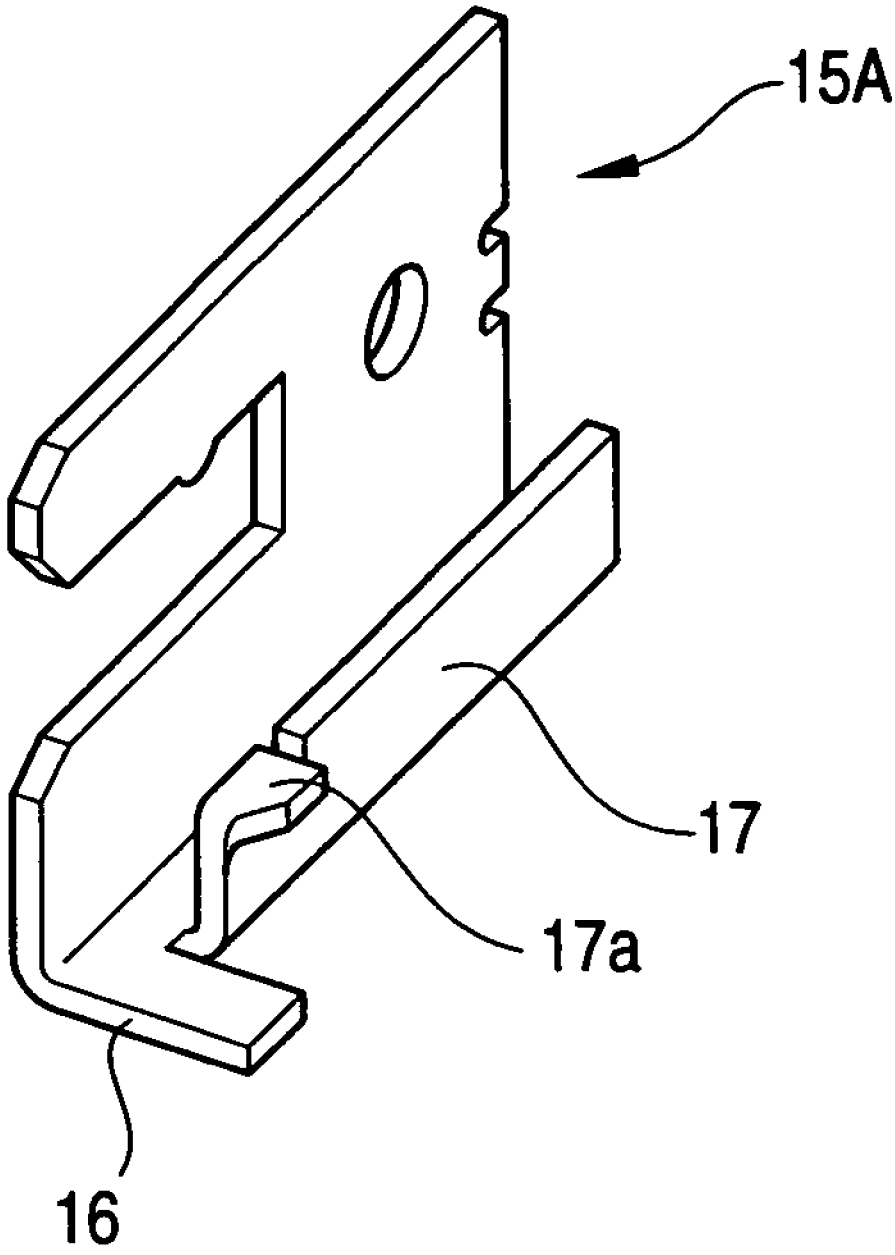
FIG. 4 is a perspective view illustrating a metal fastening member to be inserted into the board mounting type connector.

As shown in FIGS. 1, 2 and 4 (which illustrates only the metal fastening member 15A), each of these metal fastening members 15A and 15B has a leg part 16. The housing 10 is fastened to the circuit board P by soldering the leg part 16 to the circuit board P.

Each of the metal fastening members 15A and 15B has a elastic member 17 (engaging member) (see FIG. 4) integrally formed therewith which can be bent in the widthwise direction in the housing 10 (the fitting recess 10*a*). The elastic member 17 has a hook 17*a* (engaging portion) at the front end thereof. When the connectors are fitted with each other, the elastic member 17 is engaged with the housing 20 of the wiring material-side connector C1, to be described below, in order to lock both connectors to each other in the fitted state. In other words, the metal fastening members 15A and 15B further have a function of locking the connectors to each other.

As shown in FIG. 2, the elastic members 17 of the metal fastening members 15A and 15B are offset upward and downward. For this reason, the metal fastening members 15A and 15B can be compactly received in the housing 10, whereby efficiency of space utilization in the widthwise direction of the board-side connector C2 can be improved.

Figure 5B:
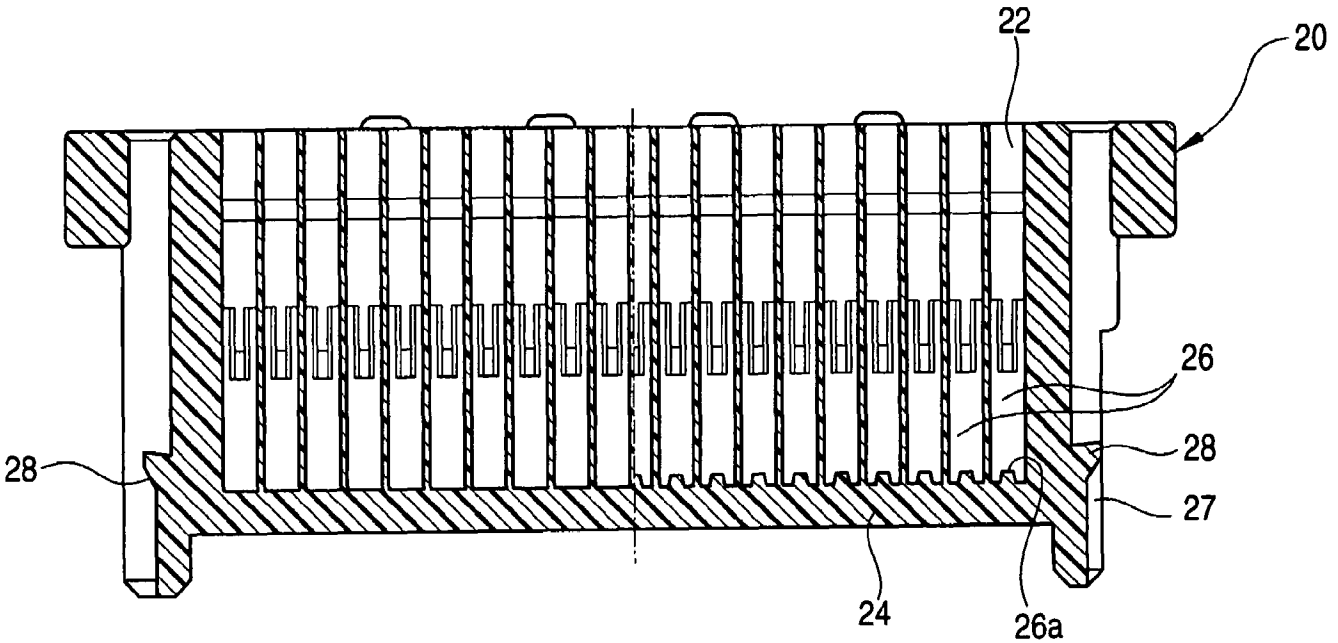
FIG. 5A is a front view and FIG. 5B is a cross-sectional view taken along the line C-C of FIG. 5A.
Figure 5A:
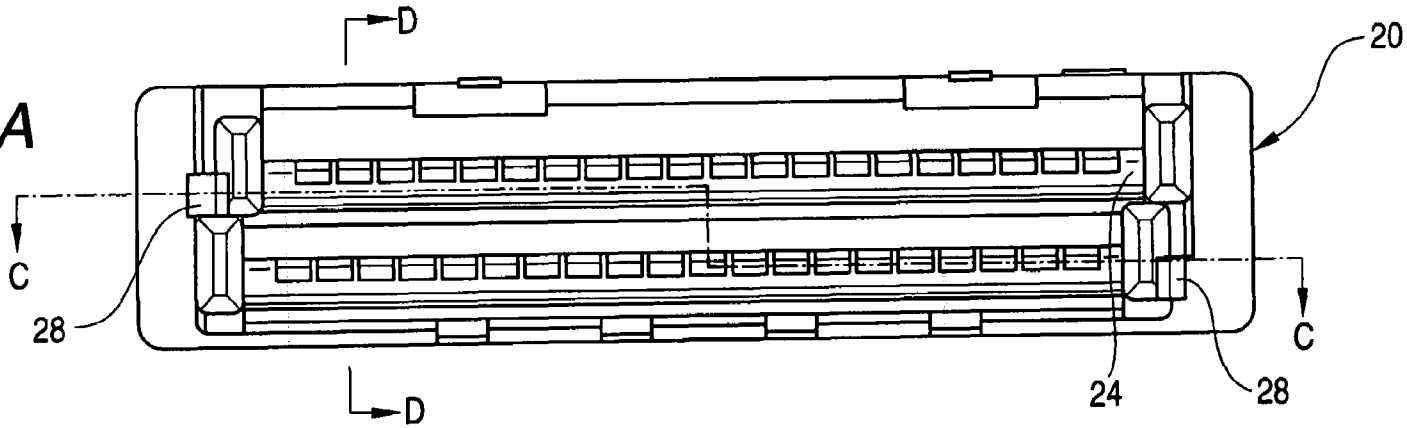

Meanwhile, as shown in FIGS. 1 and 5, the wiring material-side connector C1 has the connector housing 20 (hereinafter, referred to as a housing 20). The housing 20 has a configuration which is slim and long in the widthwise direction of the housing 20. In the housing 20, a plurality of terminal-receiving cavities 22 are provided in parallel in the widthwise direction so as to create a two-tier array including upper and lower terminal-receiving cavities 22. A terminal 5, which is mounted to the distal end of a discrete wire 3, is received in each of the terminal-receiving cavities 22.

The upper and lower terminal-receiving cavities 22 are staggered from each other by one half pitch to allow the upper and lower terminal-receiving cavities 22 to be arranged alternately with each other. As a result, in the same manner as the housing 10 of the board-side connector C2, the terminal-receiving cavities 22 are arrayed in a zigzag over the entire housing.

A pair of tongue-shaped terminal support parts 24 projects from the front end of the housing 20, that is, at the front end of a connector connecting direction, so as to correspond to the upper and lower terminal-receiving cavities 22.

Figure 6A:
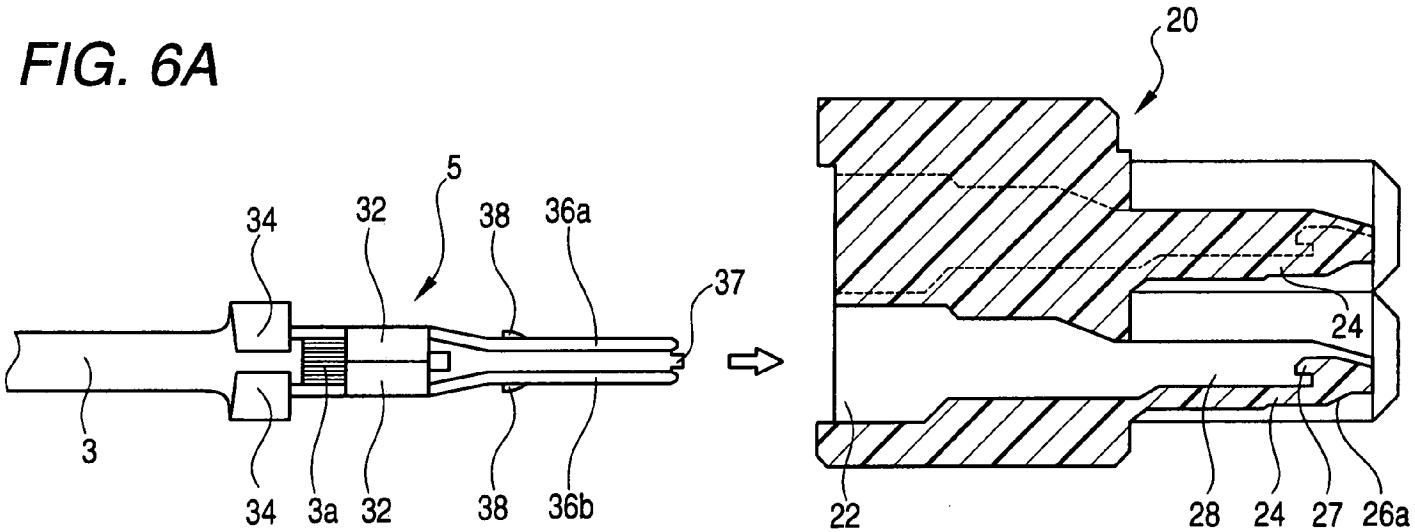

The terminal support parts 24 serve to support the contact portions 5*b* of the terminals 5, which are respectively received in the terminal-receiving cavities 22, to be described below. As shown in FIGS. 5 and 6, a plurality of support grooves 26 is provided in parallel in the widthwise direction on the upper surface of each of the terminal support parts 24, such that the support grooves 26 are opened upward and each communicate with the terminal-receiving cavities 22. On the front end wall 26*a* of each of the support grooves 26, a projection 27, which prevents the contact portion 5*b* of each of the terminals 5 from moving upward, protrudes rearward (leftward in FIG. 6).

The discrete wire 3 is a single wire that has pairs of twisted wires covered with a sheath (an insulation layer). As described above, the terminal 5 is mounted to the distal end of each of the discrete wires 3.

Figure 7A:
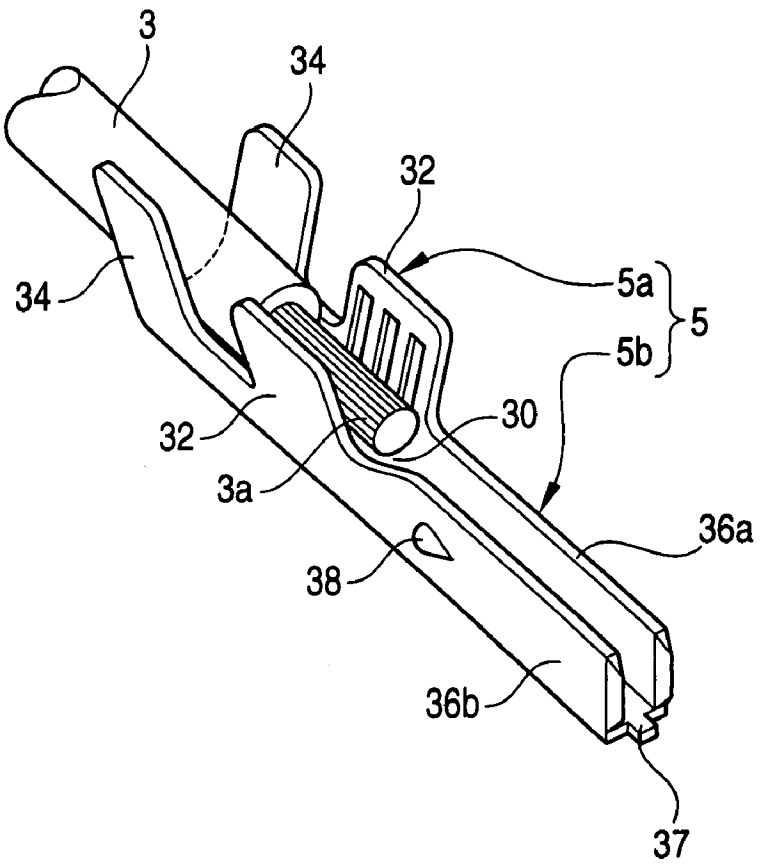

As shown in FIG. 7A, the terminal 5 is a male terminal which includes a wire holding part 5*a* for holding the discrete wire 3 and the contact portion 5*b*, which is formed in a tap shape, provided to the distal end of the wire holding part 5*a* and having a tab-shaped configuration.

The wire holding part 5*a* is abreast provided with a pair of wire barrels 32 and a pair of insulation barrels 34, which are perpendicularly erected at both sides of a bottom plate 30 of the terminal in the forward and rearward direction.

The contact portion 5*b* is formed in a substantially U-shape. The contact portion 5*b* includes a connection portion 37 which is connected to the bottom plate 30 and extends in the forward and rearward direction, and a pair of unit contact portions 36*a* and 36*b* which is perpendicularly erected at both sides of the connection portion 37 and stands in line with the pair of wire barrels 32 and the pair of insulation barrels 34. The pair of unit contact portions 36*a* and 36*b* are parallel to each other and have a configuration which is slim and long in the forward and rearward direction. Adjacent to the proximal ends of the pair of unit contact portions 36*a* and 36*b*, a pair of hooks 38 for engaging the terminal 5 with the housing 20 are integrally formed on the outer surfaces, respectively, of the pair of unit contact portions 36*a* and 36*b*.

Figure 7B:
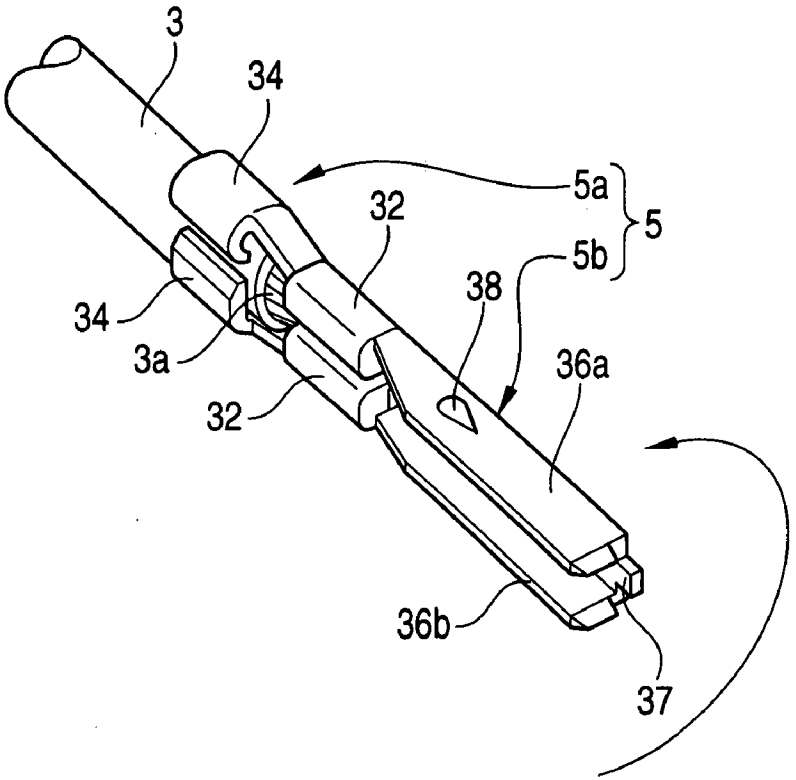
Figure 8A:
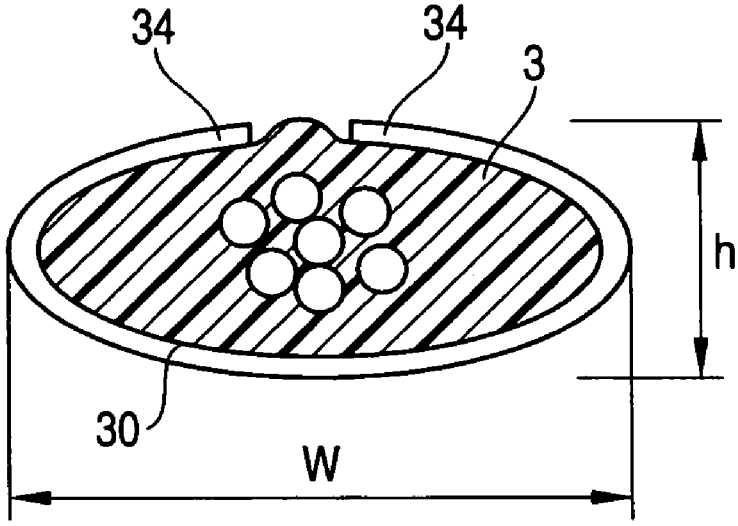
FIG. 8A is a cross-sectional view illustrating a pair of insulation barrels of the terminal mounted to the discrete wire.
Figure 8B:
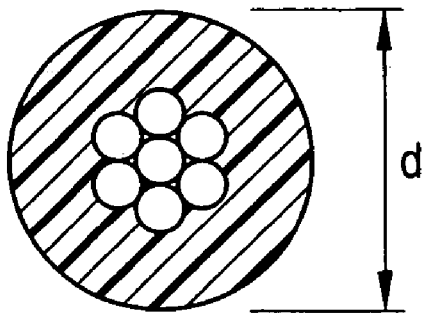
FIG. 8B is a cross-sectional view illustrating the discrete wire before the terminal is mounted thereto.

As shown in FIGS. 7A and 7B, a conductor 3*a* is exposed to the outside by removing the sheath of the distal end portion of the discrete wire 3. The mounting of the terminal 5 to the discrete wire 3 is performed in a manner such that the wire barrels 32 are crimped against the conductor 3*a* and the insulation barrels 34 are crimpled against the discrete wire 3 including the sheath. Here, in order to ensure a conductive performance and holding force of the wire barrels 32, the wire barrels 32 are tightly crimped such that the distal ends of the wire barrels 32 are penetrated into the conductor 3*a*. The insulation barrels 34 are crimped such that the distal ends of the insulation barrels 34 embrace the discrete wire 3 including the sheath and are flattened to be positioned on the same plane. Specifically, as shown in FIG. 8, the insulation barrels 34 are crimped against the discrete wire 3 such that the crimping width w is sufficiently greater than the crimping height h and the crimping height h is less than the diameter d of the discrete wire 3 (see FIG. 8B). For this reason, the entire wire holding part 5*a* including the discrete wire 3 is maintained in the flattened state.

Figure 6B:
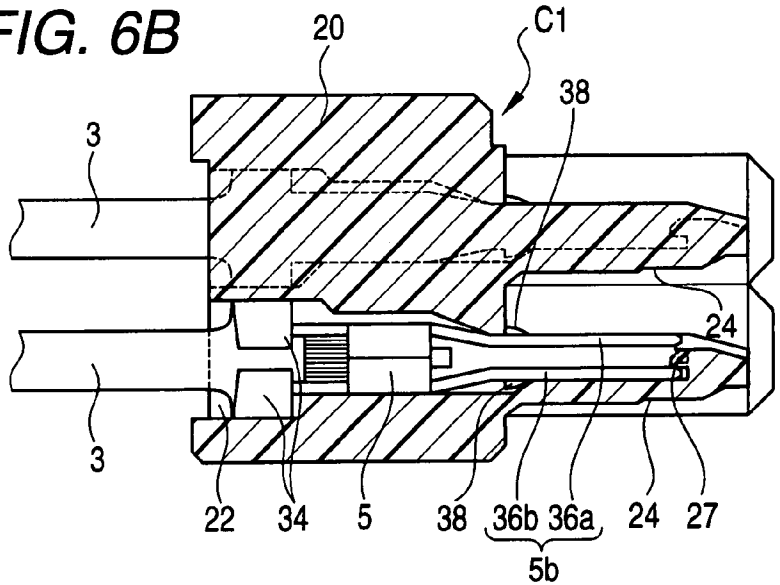

Each of the terminals 5, which is mounted to the distal end of the discrete wire 3, is received in each of the terminal-receiving cavities 22. The terminal 5 is received in the terminal-receiving cavity 22 such that the terminal 5 is inserted into the terminal-receiving cavity 22 from the rear of the housing 20 with the terminal 5 turned aside as shown in FIG. 7(*b*) to allow the crimping height h of the insulation barrels 34 to extend in the array direction of the terminal-receiving cavities 22 (in the widthwise direction of the housing 20), as shown in FIGS. 1 and 6. In detail, the terminal 5 is inserted into the terminal-receiving cavity 22 such that the distal end (the contact portion 5*b*) of the terminal 5 projects forward out of the terminal-receiving cavity 22 and is received in the support groove 26 of the terminal support part 24. At this time, the terminal 5 is inserted into the housing 20 until the distal end of the contact portion 5*b* is brought into contact with the front end wall 26*a* of the support groove 26. As shown in FIG. 6B, the projection 27 formed on the front end wall 26*a* of the support groove 26 is inserted between the pair of unit contact portions 36*a* and 36*b* of the contact portion 5*b*, and the pair of hooks 38 formed on the pair of unit contact portions 36*a* and 36*b* are engaged with the edge of the housing 20 which forms the exit (the front end) of the terminal-receiving cavity 22. For this reason, the contact portion 5*b* of the terminal 5 is exposed to the outside, and, with the distal end of the contact portion 5*b* captured by the projection 27 not to be moved or fluctuated upward and downward, the terminal 5 is received and held in the housing 20 together with the discrete wire 3.

Figure 9:
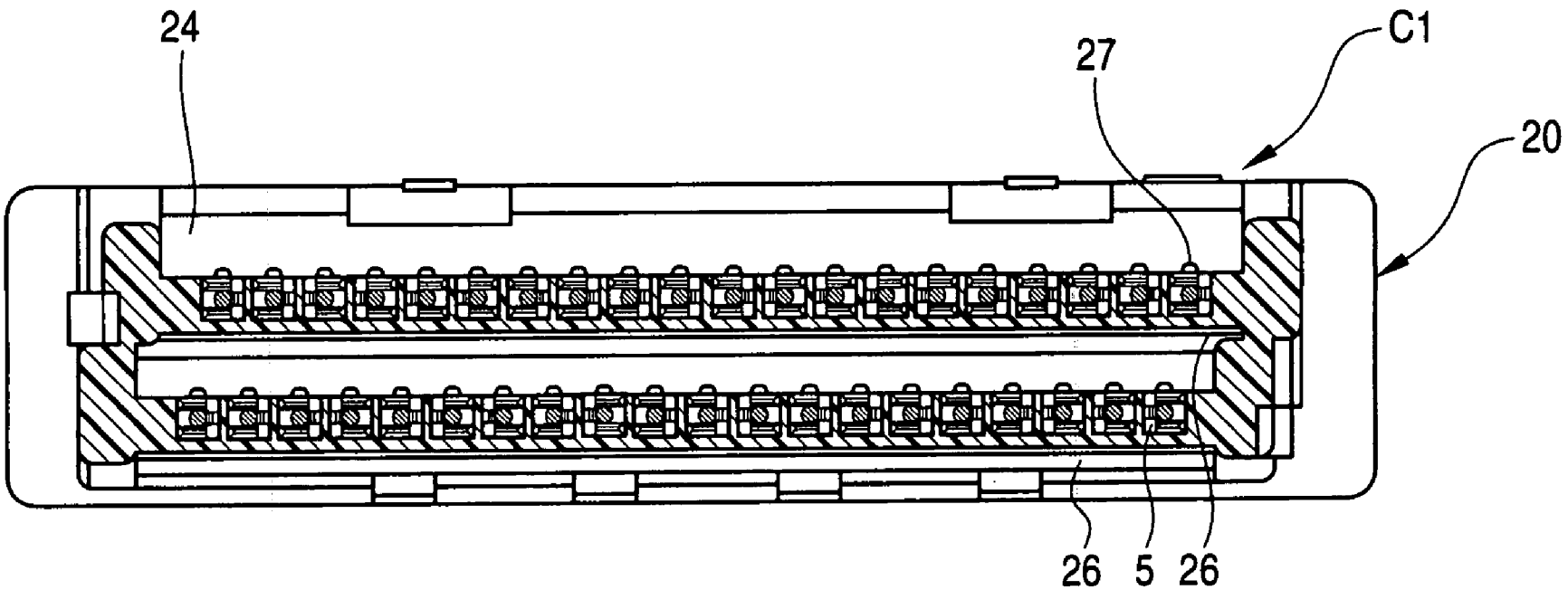
FIG. 9 is a longitudinal cross-sectional view illustrating a terminal support part of the wiring material-side connector.
Figure 10:
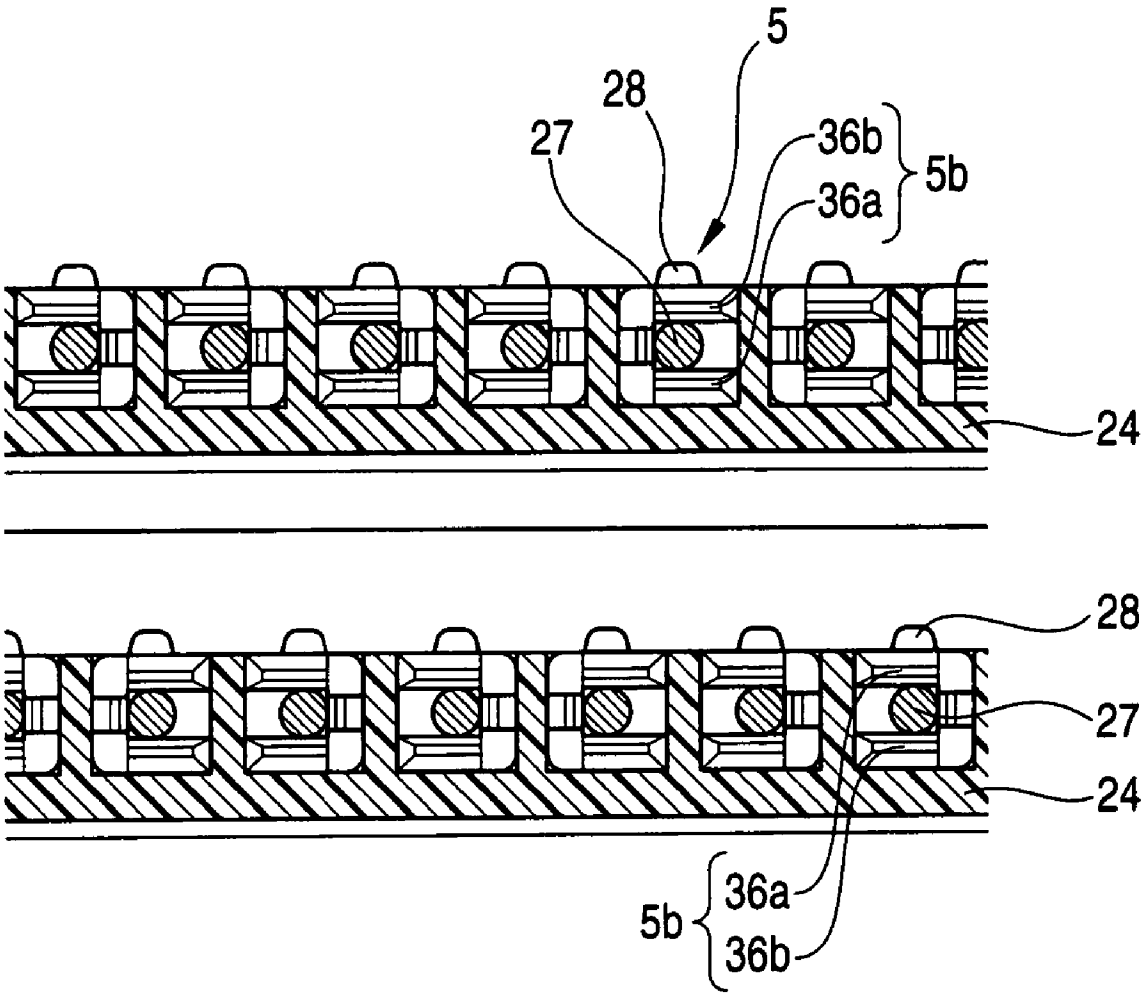
FIG. 10 is a partial enlarged view of FIG. 9.

The terminal-receiving cavity 22 of the housing 20 has a cross-sectional shape, which is substantially symmetrical in the longitudinal and transverse directions. Thus, even in a state in which the terminal 5 faces leftward or rightward, that is, the crimped surface of the terminal 5 for holding the discrete wire 3 faces one side or the other side (leftward or rightward in FIGS. 9 and 10) in the array direction of the terminal-receiving cavities 22 (the support grooves 26), it is possible to insert the terminal 5 into the housing 20. Also, as shown in FIGS. 9 and 10, the terminal support part 24 has the projection 27 so that the height of any one of the unit contact portions 36*a* and 36*b* which is positioned one above the other can be made constant by properly constraining the upward and downward movement of the contact portion 5*b*, even when the terminal 5 is inserted into the terminal-receiving cavity 22 with the crimped surface of the terminal 5 facing any direction, that is, leftward or rightward. For this reason, even when the terminal 5 is inserted into the terminal-receiving cavity 22 with the crimped surface of the terminal 5 facing any direction, that is, leftward or rightward, the terminal 12 of the board-side connector C2 can be reliably brought into contact with any one of the unit contact portions 36*a* and 36*b*.

Further, as shown in FIGS. 1 and 5, at the both ends of the housing 20, locking portions 28 (engaging portions) are integrally formed on the side surfaces of the housing 20 so as to correspond to the elastic members 17 of the board-side connector C2.

Figure 11A:
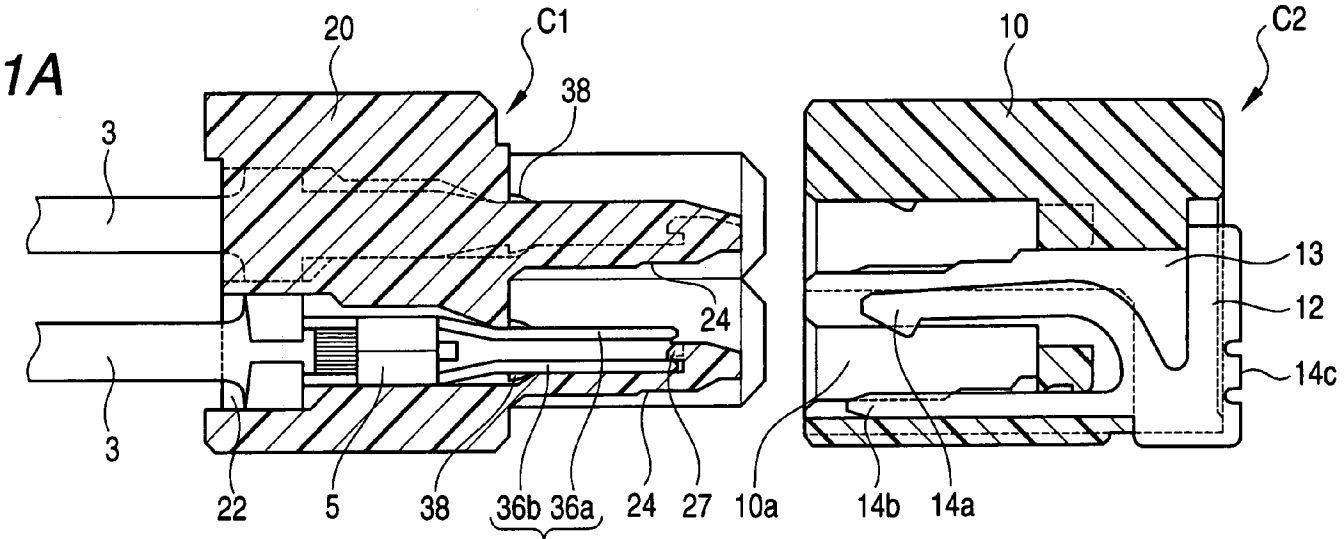
Figure 11B:
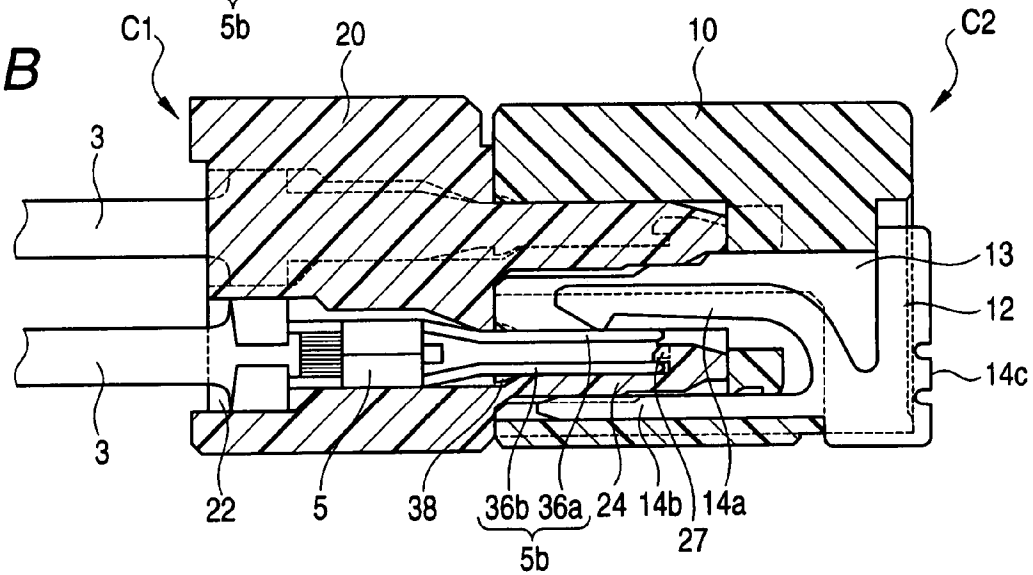
Figure 12A:
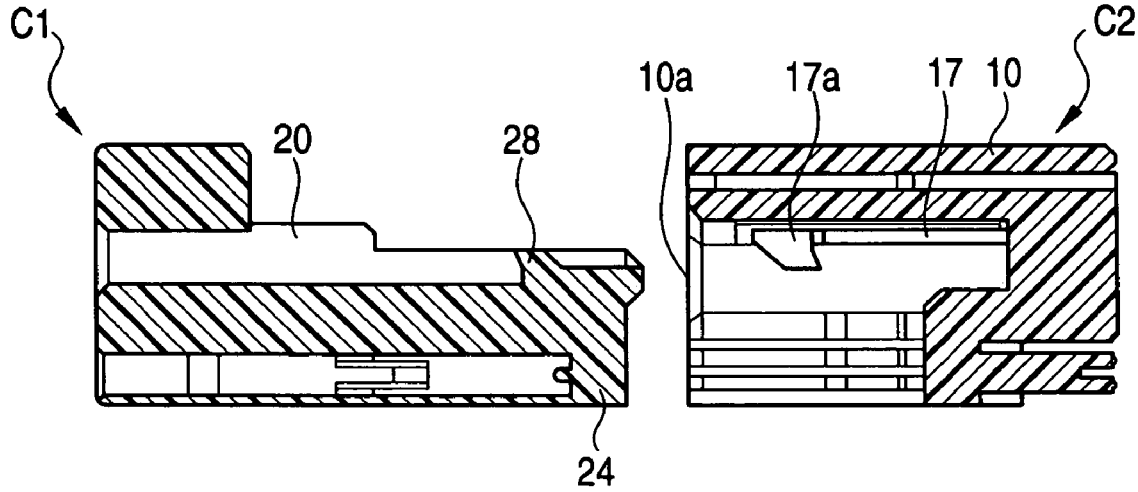
Figure 12B:
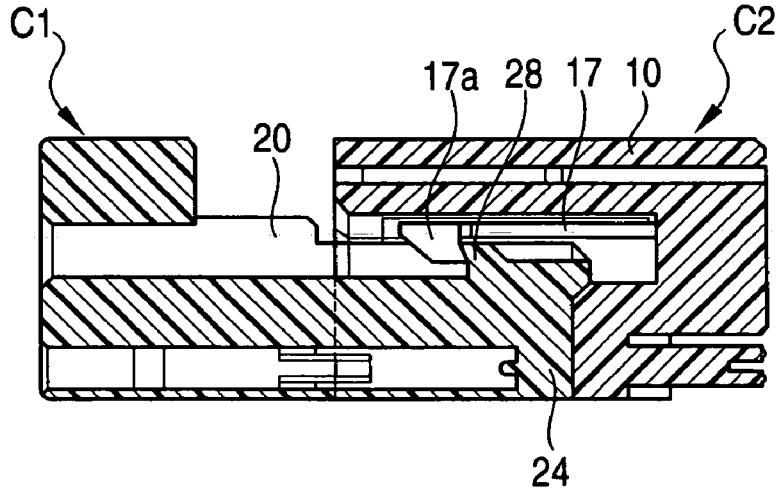

In the above-described constructions of the connectors C1 and C2, in order to combine both connectors C1 and C2 thereby connecting the discrete wire 3 to the circuit board P, as shown in FIGS. 11(*a*) and 11(*b*), with the wiring material-side connector C1 facing the fitting recess 10*a* of the board-side connector C2, both terminal support parts 24 of the wiring material-side connector C1 are inserted into the fitting recess 10*a*. In more detail, the housings 10 and 20 of both connectors C1 and C2 are fitted to each other such that the upper terminal support part 24 of the wiring material-side connector C1 is inserted between the flexible pieces 14*a* and the support portions 14*b* of the upper terminals 12, and, in the same manner, the lower terminal support part 24 of the wiring material-side connector C1 is inserted between the flexible pieces 14*a* and the support portions 14*b* of the lower terminals 12. In this way, as the housing 20 is inserted, when each of the elastic members 17 of the board-side connector C2 is bent outward, whereby both connectors C1 and C2 are completely fitted with each other, as shown in FIG. 12B, the elastic member 17 elastically returns to its original unbent state from the bent state such that the hook 17*a* is engaged with the engaging portion 28 of the housing 20, whereby both connectors C1 and C2 are locked to each other in the fitted state. If the connectors C1 and C2 are completely fitted with each other, as shown in FIG. 11B, the flexible piece 14*a* of the terminal 12 is brought into contact with the contact portion 5*b* of the terminal 5 mounted to the discrete wire 3. In more detail, the flexible piece 14*a* of the terminal 12 is brought into contact with the upwardly positioned unit contact portion 36*a* (or 36*b*) of the unit contact portions 36*a* and 36*b*, and by this contact, each discrete wire 3 is connected to a circuit of the circuit board P through the corresponding terminal 12.

According to the connector having above-mentioned structure, since the hooks 17*a* are formed on the metal fastening members 15A and 15B inserted into the board-side connector C2 and are engaged with the housing 20 of the counterpart connector C1 to lock both connectors C1 and C2 with each other in the fitted state, that is, since the metal fastening members 15A and 15B perform the function of locking the connectors, it is not necessary to form engaging portions on the housing 10 of the board-side connector C2. For this reason, differently from the conventional connector in which the engaging portions are formed on the housing of the connector, the design and manufacture of the housing is not complicated when considering a relationship with molds. As a consequence, it is possible to miniaturize the housing of the connector and to simply form the hooks 17*a* when compared to the related art. In addition, since the hooks 17*a* are made of metal to be advantageous in terms of strength, it is possible to prevent the deformation of the hooks 17*a*, whereby locking strength between both connectors can be improved.

The hook 17*a* is integrally formed on the elastic member 17 of each of the metal fastening members 15A and 15B which can be bent in the widthwise direction. Moreover, when fitting the connectors with each other, as the wiring material-side connector C1 (the housing 20) is inserted into the board-side connector C2 (the housing 10), the elastic member 17 is bent outward (see the two-dot chain line in FIG. 12(*b*)). Then, when both housings 10 and 20 are completely fitted with each other, the elastic member 17 elastically returns to its original unbent state and is engaged with the housing 20. Therefore, workability when fitting the connectors C1 and C2 with each other can be improved. That is, when the housings 10 and 20 are completely fitted with each other and the elastic member 17 returns to its original unbent state from the bent state, since the elastic member 17 strikes (clashes upon) the side surface of the housing 20, a worker can perceive the lock feeling by the clash sound or vibration (clash feeling). In particular, since the elastic member 17 is formed of metal having elasticity whereby the vibration or the clash sound becomes more loud, the worker can adequately perceive the completely fitted state of both housings 10 and 20, that is, the lock feeling. As a result, both connectors C1 and C2 can be adequately and quickly fitted with each other.

In the board-side connector C2, the elastic members 17 are respectively formed on the metal fastening members 15A and 15B and are engaged with the housing 20 of the wiring material-side connector C1. In addition, in one embodiment, as shown in FIG. 2, since the elastic members 17 are offset from each other upward and downward, it is possible to effectively accomplish the miniaturization of the board-side connector C2.

In detail, in the board-side connector C2, as shown in FIG. 2, the upper terminal-receiving cavities 13 are staggered leftward from the lower terminal-receiving cavities 13 by one half pitch, the elastic member 17 of the left metal fastening member 15A is formed abreast of the lower terminal-receiving cavities 13, and the elastic member 17 of the right metal fastening member 15B is formed to face the upper terminal-receiving cavities 13. In other words, the elastic members 17 are respectively formed on the metal fastening members 15A and 15B such that, the elastic member 17 is located at a side of one terminal 12, which is closer to the widthwise center of the housing 10 than the other terminal 12, of the two terminals 12 which are respectively positioned at both ends of each terminal array. That is, since the upper and lower terminal-receiving cavities 13 are offset from each other in the leftward and rightward direction, in the upper terminal-receiving cavities 13, it is possible to form a dead space at the right end of the housing 10, and in the lower terminal-receiving cavities 13, it is possible to form a dead space at the left end of the housing 10. Hence, in the board-side connector C2, since the elastic members 17 are formed on the respective metal fastening members 15A and 15B such that the elastic members 17 are disposed in these dead spaces, the metal fastening members 15A and 15B can be compactly inserted into the housing 10 while securing sufficient flexure margin of the elastic members 17. Accordingly, in this regard, it is possible to effectively accomplish the miniaturization of the board-side connector C2.

Furthermore, the following advantages are further obtained by the connectors C1 and C2 according to the above-described embodiment.

That is, in regard to the structure for holding the terminal 5 in the wiring material-side connector C1, the terminals 5 are mounted to the discrete wire 3 such that the crimping height h of the insulation barrels 34 is less than the crimping width w (less than the diameter d of the discrete wire 3) to be maintained in the flattened state. Further, the terminals 5 are transversely received in the housing 20 such that the crimping height h of the insulation barrels 34 extends in the array direction of the terminal-receiving cavities 22. In other words, the wiring material-side connector C1 is configured in a manner such that the terminals 5 are received in the housing 20 in a state in which the terminals 5 are arranged in the direction of the crimping height h of the insulation barrels 34. Therefore, the terminals 5 can be arranged with a decreased pitch, whereby it is possible to receive the terminals 5 in the housing 20 at the same pitch as the conductor 6*a* of a flat wiring member 6 without using a complicated terminal structure. That is, in the related art, since the insulation barrels of a terminal are crimped to embrace the discrete wire such that the cross-sectional shape of a discrete wire is maintained as it is, the determination of a pitch is restrained by the crimping width of the insulation barrels, whereby it is difficult to decrease the pitch. On the contrary, according to the construction of the wiring material-side connector C1 as described above, since the terminals 5 are arranged in the direction of the crimping height h of the insulation barrels 34, the determination of a pitch is not restrained by the crimping width w. In addition, since the insulation barrels 34 are crimped against the discrete wire 3 to be maintained in the flattened state in which the crimping height h is less than the crimping width w, a space occupied by the terminals in the array direction of the terminals can be effectively decreased, whereby the terminals can be arranged with a decreased pitch. Therefore, it is possible to receive the terminals 5 in the housing 20 at the same pitch as the conductor 6*a* of a flat wiring member 6 without using a complicated terminal structure.

The board-side connector C2 of the above-described connectors represents an example of a board mounting type connector according to an embodiment of the invention, and the specific construction of the board-side connector C2 can be properly modified without departing from the scope and spirit of the above-embodiments. For example, the constructions as will be described in first and second variations of the invention with reference to FIGS. 13 through 17 can be adopted as a structure for locking the connectors C1 and C2 in the fitted state. Furthermore, since these variations of the embodiments have the same basic construction as the above-described embodiment, the same reference numerals will be given to the same or like parts, and only the differences between them will be described in detail hereafter.

<First Variation>

Figure 13:
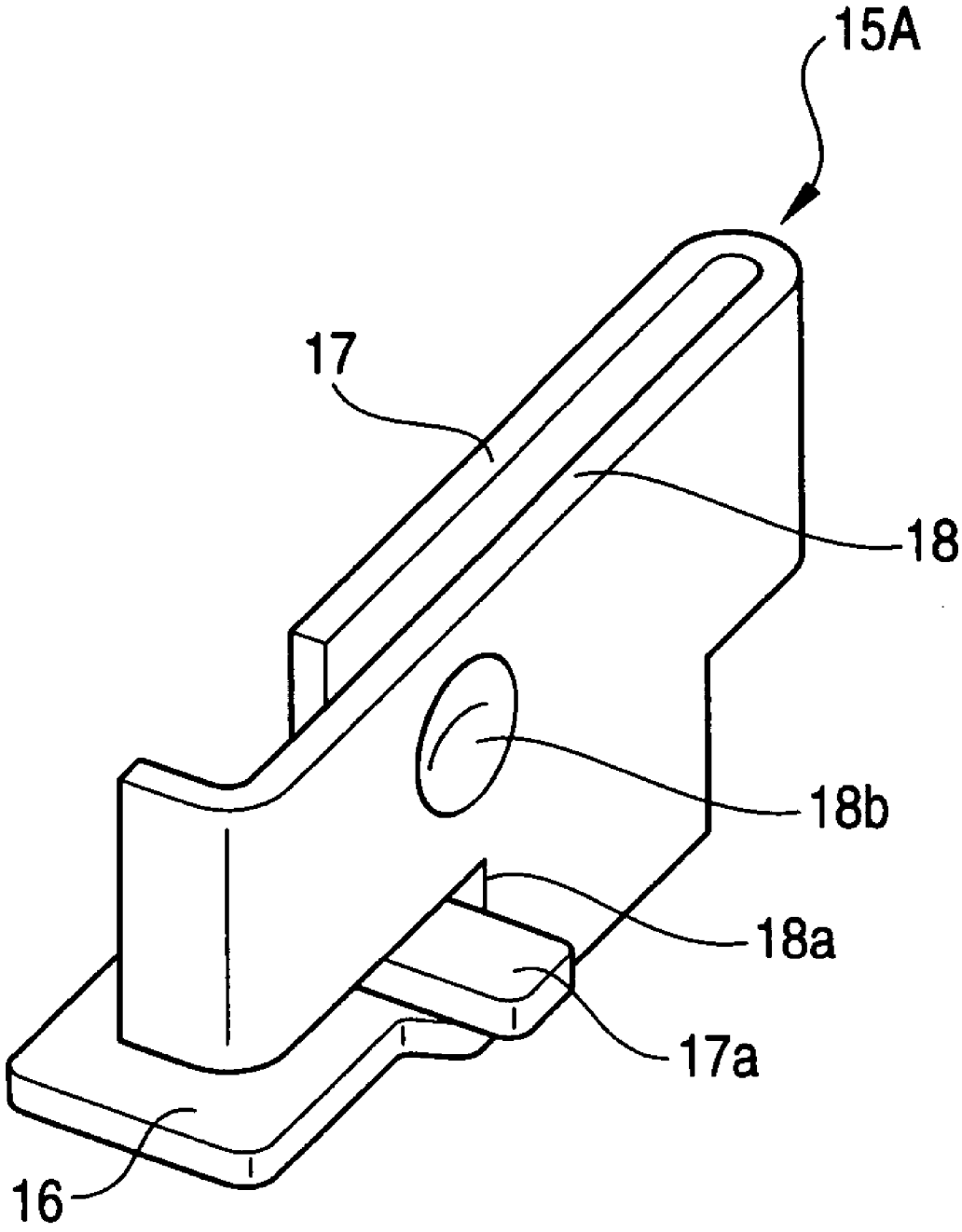
FIG. 13 is a perspective view illustrating another example of the metal fastening member.
Figure 14:
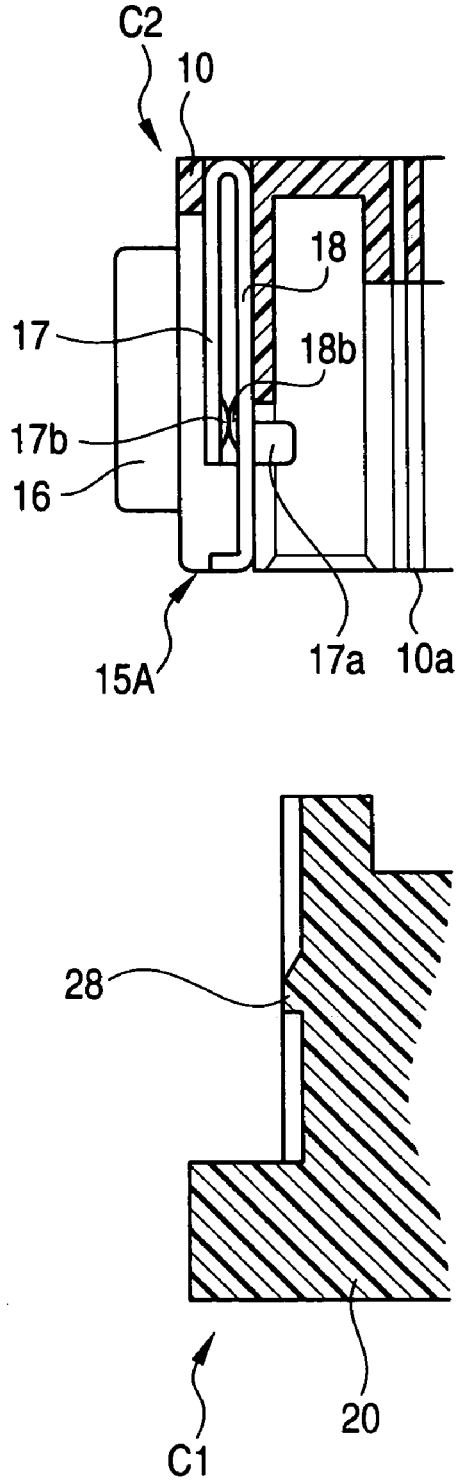
FIG. 14 is a cross-sectional view illustrating main parts for locking a board mounting type connector and a wiring material-side connector according to another embodiment.

FIG. 13 is a perspective view illustrating another example of the metal fastening member (only the metal fastening member 15A is shown), and the FIG. 14 is a cross-sectional view illustrating main parts of the wiring material-side connector C1 and the board-side connector C2.

As shown in FIGS. 13 and 14, in the metal fastening member 15A according to this first variation of the invention, a contact plate part 18 is formed integrally with the metal fastening member 15A in a manner such that the contact plate part 18 (contact portion) is positioned inward of the elastic member 17, that is, closer to the terminals 12 than the elastic member 17 in the housing 10 (the fitting recess 10*a*) and is parallel to the elastic member 17.

The contact plate part 18 is provided with a notch portion 18*a* in a manner such that the distal end of the hook 17*a* of the elastic member 17 can project through the notch portion 18*a* into the fitting recess 10*a*.

The distal end (the lower end in FIG. 14) of the elastic member 17 and a portion of the contact plate part 18 corresponding thereto each have protrusions (hereinafter, referred to as embossing portions 17*b* and 18*b*) which are formed by an embossing process on the elastic member 17 and the contact plate part 18, respectively, to protrude toward each other. These embossing portions (the protrusions) 17*b* and 18*b* are brought into contact with each other in the direction in which the elastic member 17 is bent.

Figure 15B:
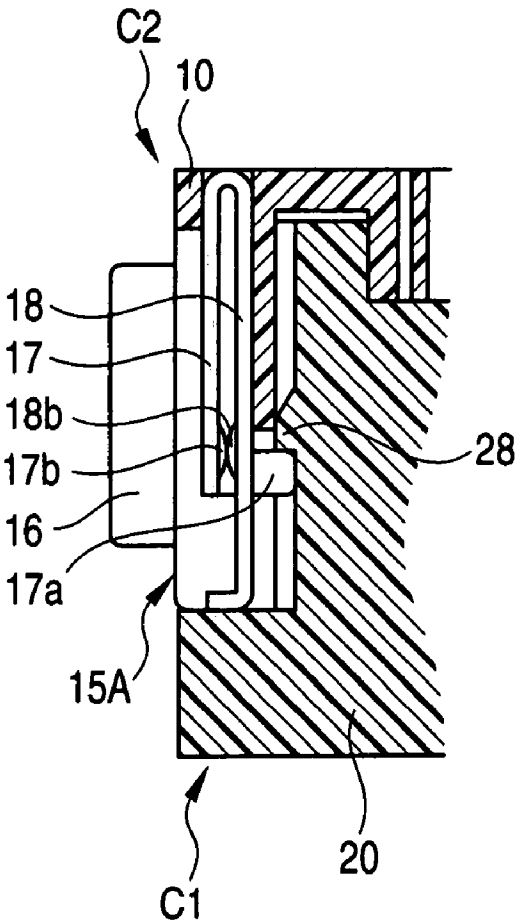
FIG. 15A represents a connection proceeding state and FIG. 15B represents a connection completed state.
Figure 15A:
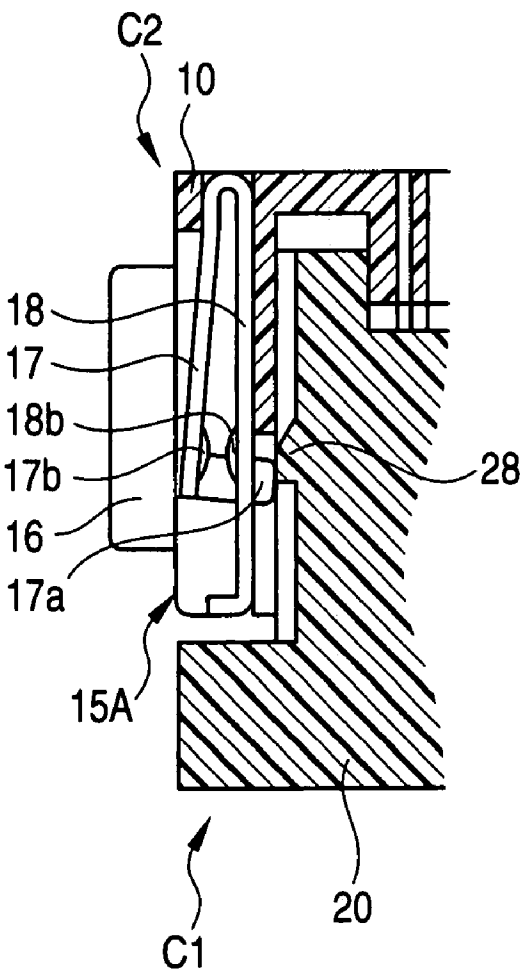

According to the above-described construction of the first variation of the invention, as shown in FIG. 14, with the wiring material-side connector C1 facing the fitting recess 10*a* of the board-side connector C2, both terminal support parts 24 of the wiring material-side connector C1 are inserted into the fitting recess 10*a*. Then, as shown in FIG. 15A, as the housing 20 is inserted into the fitting recess 10*a*, the elastic member 17 of the board-side connector C2 is bent outward by the engaging portion 28 of the housing 20. Thereafter, when both connectors C1 and C2 are completely fitted with each other, as shown in FIG. 15B, the elastic member 17 elastically returns to its original unbent state from the bent state so that the hook 17*a* is engaged with the engaging portion 28 of the housing 20. As a result, both of the connectors C1 and C2 are locked to each other in the fitted state. In the first variation of the invention, when the elastic member 17 returns from the bent state, since metallic materials (that is, the elastic member 17 and the contact plate part 18) clash to each other and the clashing portions of the elastic member 17 and the contact plate part 18 have undergone the embossing process (are provided with the embossing portions 17*b* and 18*b*), clear clash sound can be generated. For this reason, when compared to the above-described embodiment in which the elastic member 17 clashes against the housing 20, improved lock feeling can be obtained, whereby workability can be further improved when fitting the connectors with each other.

In this construction, although the embossing portions (17*b* and 18*b*) are respectively formed on the contact portions of the elastic member 17 and the contact plate part 18, only one embossing portion may be formed on one of the elastic member 17 and the contact plate part 18.

Also, it is possible to plane-to-plane clash the elastic member 17 and the contact plate part 18 upon each other, and, if sufficient lock feeling (sound or vibration) can be obtained through the plane-to-plane clash, the embossing portions may be omitted to simplify the construction of the metal fastening members 15A and 15B.

Further, FIGS. 13 to 15, although only one metal fastening member (the metal fastening member 15A) of the metal fastening members 15A and 15B which are inserted into the housing 10 of the board-side connector C2 is illustrated, it is to be readily understood that the other metal fastening member (the metal fastening member 15B) has the same construction as the one metal fastening member.

<Second Variation>

Figure 16:
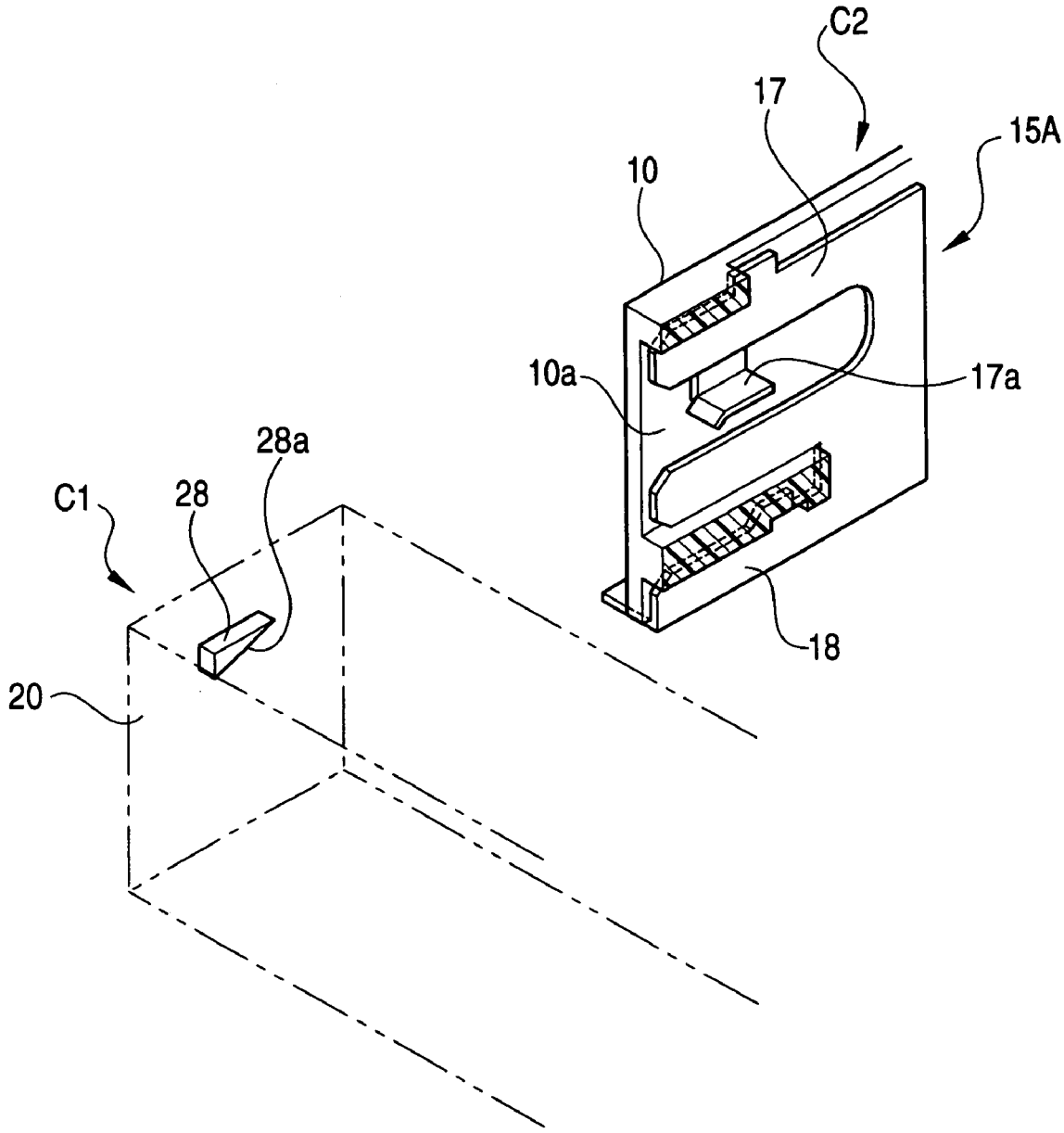
FIG. 16 is a perspective view illustrating main parts for locking a board mounting type connector and a wiring material-side connector according to another embodiment.
Figure 17:
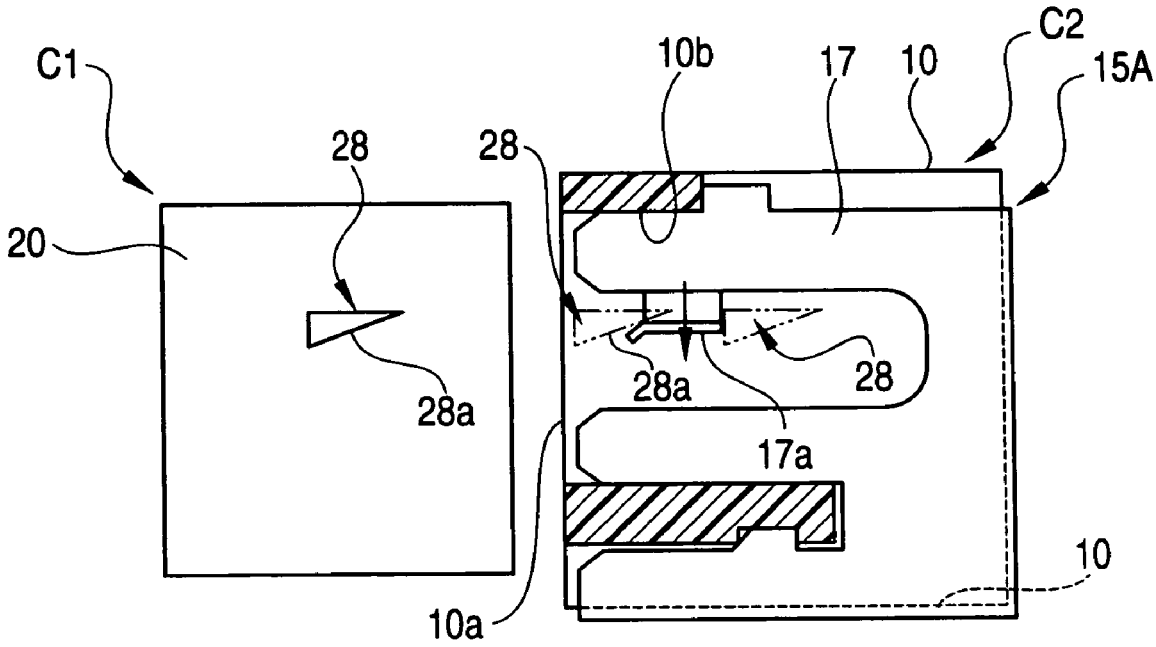
FIG. 17 is a cross-sectional view illustrating main parts of the board mounting type connector and the wiring material-side connector according to another embodiment.

FIGS. 16 and 17 illustrate main parts of the wiring material-side connector C1 and the board-side connector C2 according to a second variation of the invention, specifically, the construction for locking the connectors C1 and C2 in the fitted state. FIG. 16 is a perspective view and FIG. 17 is a cross-sectional view.

In the second embodiment of the present invention shown in FIGS. 16 and 17, the elastic member 17 of the metal fastening member 15A of the board-side connector C2 is formed to be able to be bent in the housing 10 (the fitting recess 10*a*) upward and downward. In a state in which the connectors C1 and C2 are not fitted with each other, the upper surface of the distal end of the elastic member 17 is brought into contact with the contact portion 10*b*, which is formed in the housing 10 (the fitting recess 10*a*).

In the wiring material-side connector C1, the engaging portion (locked portion) 28 of the housing 20 is formed in a shape of a triangular prism as shown in FIG. 17. In detail, the triangular prism projects outward in the widthwise direction of the housing 20. The triangular prism has an inclined guide surface 28*a* on a lower side thereof, which is inclined downward from the front portion to the rear portion thereof (from the right to the left in FIG. 17) when viewed in the connector connection direction.

In the above-described construction of the second variation of the invention, with the wiring material-side connector C1 facing the fitting recess 10*a* of the board-side connector C2, if the wiring material-side connector C1 is inserted into the fitting recess 10*a*, the elastic member 17 (the hook 17*a*) of the board-side connector C2 is pressed downward along the guide surface 28*a* of the engaging portion 28 and bent downward as shown by an arrow in FIG. 17. Then, when both connectors C1 and C2 are completely fitted with each other, the engaging portion 28 passes over the hook 17*a* and the elastic member 17 returns to its original unbent state from the bent state as shown by the two-dot chain line in FIG. 17. As a result, the hook 17*a* is engaged with the engaging portion 28 of the housing 20 and both connectors C1 and C2 are locked to each other in the fitted state. At this time, in this second variation of the invention, when the elastic member 17 returns to its original unbent state from the bent state, the elastic member 17 clashes upon the contact portion 10*b* of the housing 10 to generate clash sound and vibration. That is, in this construction of the second variation, the completely fitted state of the connectors C1 and C2 can be confirmed by the clash sound or the vibration. Accordingly, it is possible to effectively provide lock feeling to the worker, and workability can be improved when fitting the connectors with each other as in the same manner as the first variation of the invention. Specifically, in this second variation of the invention, since the elastic member 17 is brought into contact with the outer housing 10 (the contact portion 10*b*) of the housings 10 and 20 fitted to each other outside and inside, the worker can easily perceive the sound or vibration (clash feeling), whereby lock feeling can be improved.

Also, in the embodiment of the invention, the elastic members 17 are formed on the metal fastening members 15A and 15B of the board-side connector C2 and the hooks 17*a* are formed on the elastic members 17. However, for example, it is to be readily understood that the hooks 17*a* can be formed on the metal fastening members 15A and 15B, the only elastic members 17 can be formed on the counterpart connector (the wiring material-side connector C1), and the engaging portions 28 can be formed on the elastic members 17.

Further, although it was described that the invention is applied to the board-side connector C2 when connecting the discrete wire 3 to the circuit board P, it is to be readily appreciated that the present invention can be applied to the board-side connector when connecting a flat wiring material such as a flat cable in which straight angle conductors are arranged in parallel, a ribbon type wire and an FPC (flexible printed circuit) to the circuit board P.

What is claimed is:

1. A board mounting type connector comprising:

a housing being made of a resin, the housing holding a plurality of terminals, each terminal being arranged in parallel and connected to a circuit board; and a metal fastening member being inserted internally to both ends of the housing in a widthwise direction of the housing in which the terminals are arranged, the metal fastening member being mounted to the circuit board, and each metal fastening member having an engaging portion which engages with a housing of a counterpart connector fitted into the board mounting type connector so that the connectors are securely locked together to each other in a fitted state.

2. The board mounting type connector according to claim 1, wherein the engaging portion has an elastic member, wherein the elastic member is elastically displaced by a housing of the counterpart connector when the connectors are fitted with each other, and wherein when the connectors are completely fitted, the elastic member elastically returns to an original unbent state such that the engaging portion is engaged with the housing of the counterpart connector.

3. The board mounting type connector according to claim 2, wherein the housing of the board mounting type connector is provided with a fitting recess into which the housing of the counterpart connector is inserted to be fitted therein, wherein the elastic member is disposed in the fitting recess, wherein an inner surface of the fitting recess has a contact portion with which the elastic member comes into contact, wherein as the housing of the counterpart connector is inserted into the fitting recess, the elastic member is elastically bent by the housing of the counterpart connector in a direction in which the elastic member goes away from the contact portion, and wherein when both of the connectors are completely fitted with each other, the elastic member elastically returns to an original unbent state and comes into contact with the contact portion.

4. The board mounting type connector according to claim 3, wherein an engaged portion is formed on the housing of the counterpart connector to be engaged with the engaging portion of each metal fastening member, wherein the engaged portion of the housing of the counterpart connector has a guide surface which comes into contact with the engaging portion such that the elastic member is elastically bent in the direction in which the elastic member goes away from the contact portion, wherein as the housing of the counterpart connector is inserted into the fitting recess, the engaging portion is guided on the guide surface whereby the elastic member is elastically displaced, and wherein when the connectors are completely fitted, the engaging portion is released from the guide surface, the elastic member elastically returns to the original unbent state, and the engaging portion is engaged with the engaged portion of the housing of the counterpart connector.

5. The board mounting type connector according to claim 2, wherein each metal fastening member has a contact portion which faces the elastic member, and wherein the contact portion comes into contact with the elastic member when the elastic member returns to the original unbent state from a bent state.

6. The board mounting type connector according to claim 5, wherein at least one side of the contact portion and the elastic member contacted to the contact portion is formed with a protrusion, and wherein the protrusion protrudes toward the other side of the contact portion and the elastic member.

7. The board mounting type connector according to claim 2, wherein a plurality of terminal arrays having the plurality of terminals arranged in parallel are formed in a direction perpendicular to the widthwise direction, wherein the terminal arrays have a first terminal array and a second terminal array, wherein all terminals of the first terminal array are staggered by one half pitch from all terminals of the second terminal array in the widthwise direction; and wherein each metal fastening member has the elastic member which can be elastically bent in the widthwise direction, and wherein the elastic member is located at a side of an endmost terminal among terminals of the first and second terminal arrays which is close to a widthwise center of the housing of the board mounting type connector.

* * * * *